US010378718B2

(12) United States Patent
Kieslinger

(10) Patent No.: US 10,378,718 B2
(45) Date of Patent: Aug. 13, 2019

(54) OPTICAL STRUCTURE FOR A LIGHTING DEVICE FOR A MOTOR VEHICLE HEADLIGHT

(71) Applicant: ZIZALA LICHTSYSTEME GMBH, Wieselburg (AT)

(72) Inventor: Dietmar Kieslinger, Theresienfeld (AT)

(73) Assignee: ZKW Group GmbH, Wieselburg (AT)

( * ) Notice: Subject to any disclaimer, the term of this patent is extended or adjusted under 35 U.S.C. 154(b) by 445 days.

(21) Appl. No.: 14/916,404

(22) PCT Filed: Aug. 28, 2014

(86) PCT No.: PCT/AT2014/050189
§ 371 (c)(1),
(2) Date: Mar. 3, 2016

(87) PCT Pub. No.: WO2015/031924
PCT Pub. Date: Mar. 12, 2015

(65) Prior Publication Data

US 2016/0215946 A1 Jul. 28, 2016

(30) Foreign Application Priority Data

Sep. 3, 2013 (AT) ..... A 50542/2013

(51) Int. Cl.
*F21S 41/43* (2018.01)
*F21S 41/275* (2018.01)

(52) U.S. Cl.
CPC ..... *F21S 41/43* (2018.01); *F21S 41/275* (2018.01)

(58) Field of Classification Search
CPC ..... F21S 41/143; F21S 41/20; F21S 41/25; F21S 41/255; F21S 41/265; F21S 41/275;
(Continued)

(56) References Cited

U.S. PATENT DOCUMENTS 1,601,688 A 9/1926 Herman
1,699,224 A 1/1929 Comstock
(Continued)

FOREIGN PATENT DOCUMENTS

DE 3602262 A1 5/1987
DE 3925999 A1 2/1991
(Continued)

OTHER PUBLICATIONS

Office Action issued in Austrian Application No. A 50542/2013, dated Jul. 18, 2014 (2 pages).
(Continued)

*Primary Examiner* — William N Harris
(74) *Attorney, Agent, or Firm* — Eversheds Sutherland (US) LLP

(57) ABSTRACT

The invention relates to an optical structure (100) for a lighting device (1) of a motor vehicle headlight, which lighting device (1) is designed to radiate light, the light radiated from the lighting device (1) forming a predefined light distribution (LV1), wherein the optical structure (100) is associated with the lighting device (1) in such a way or is part of the lighting device (1) in such a way that substantially the entire flow of light from the lighting device (1) passes through the optical structure (100), and wherein the unmodified light distribution (LV1) produced by the lighting device (1) is modified by the optical structure (100) into a predefinable, modified light distribution (LV2), wherein the modified light distribution (LV2) is formed by convolution of the unmodified light distribution (LV1) with a scattering function (PSF), and wherein the optical structure (100) is designed in such a way that the unmodified light distribution (LV1) is modified according to the scattering function.

56 Claims, 13 Drawing Sheets

Figure 1:
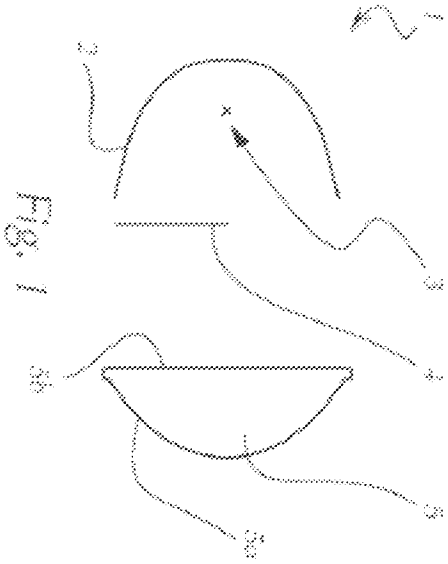
Fig. 1 (Prior Art)

(58) Field of Classification Search
CPC ..... F21S 41/28; F21S 41/60; F21V 5/045; G02B 5/021; G02B 5/0215; G02B 5/0278
See application file for complete search history.

(56) References Cited

U.S. PATENT DOCUMENTS

| | | | | |
|---|---|---|---|---|
| 6,464,382 | B1 | 10/2002 | Duflos | |
| 7,025,483 | B2 * | 4/2006 | Albou | G02B 3/00 362/538 |
| 7,139,133 | B2 | 11/2006 | Bonitz et al. | |
| 7,441,927 | B1 * | 10/2008 | Kling | F21V 5/00 362/297 |
| 8,636,397 | B2 | 1/2014 | Kiesel | |
| 9,328,888 | B2 | 5/2016 | Lamberterie et al. | |
| 9,810,390 | B2 | 11/2017 | Hagedorn et al. | |
| 2004/0051975 | A1 * | 3/2004 | Lamy | G02B 5/1814 359/737 |
| 2008/0247188 | A1 | 10/2008 | Woodward | |
| 2010/0284197 | A1 | 11/2010 | Kiesel | |
| 2012/0057363 | A1 * | 3/2012 | Ishida | F21S 41/143 362/516 |

FOREIGN PATENT DOCUMENTS

| | | | |
|---|---|---|---|
| DE | 4031352 | A1 | 4/1992 |
| DE | 29914114 | U1 | 11/1999 |
| DE | 102005009556 | A1 | 9/2005 |
| DE | 102007063569 | A1 | 7/2009 |
| DE | 102008005488 | A1 | 7/2009 |
| DE | 102008013603 | A1 | 9/2009 |
| DE | 102008023551 | A1 | 11/2009 |
| DE | 102009017424 | A1 | 10/2010 |
| EP | 2587125 | | 5/2013 |
| JP | S50-024140 | | 12/1973 |
| JP | H03-122902 | A | 5/1991 |
| JP | H09311279 | A | 12/1997 |
| JP | H11329008 | A | 11/1999 |
| JP | 2009218211 | A | 9/2009 |
| JP | 2010108689 | A | 5/2010 |
| JP | 2013073811 | A | 4/2013 |

OTHER PUBLICATIONS

International Search Report issued in Application No. PCT/AT2014/050189, dated Jan. 27, 2015 (3 pages).

* cited by examiner

OPTICAL STRUCTURE FOR A LIGHTING DEVICE FOR A MOTOR VEHICLE HEADLIGHT

The invention relates to an optical structure for a lighting device of a motor vehicle headlight, which lighting device is designed to radiate light, the light radiated from the lighting device forming a predefined light distribution.

The invention also relates to a lighting device for a vehicle headlight comprising an optical structure of this type.

The invention additionally relates to a vehicle headlight comprising at least one lighting device of this type.

In accordance with legal provisions, light distributions of vehicle headlights must satisfy a range of conditions.

For example, in accordance with the ECE and SAE, minimum and maximum light intensities are necessary in certain regions above the light-dark line (HD line)—i.e. outside the primarily lit region. These light intensities act as "signlight" and enable overhead direction signs to be lit up with illumination by passing vehicles. The used light intensities usually lie above the standard scattered light values, but fall below the light intensities below the HD line. The required light values must be attained with minimal dazzling effect.

"Signlight" is usually provided by special facets in the projection lens (measuring at least a few millimeters) or by discrete, small raised portions. A disadvantage of this is in particular the fact that these structures are perceivable externally as bright light points and therefore are being increasingly rejected, above all for design reasons. In addition, devices of this type are coordinated with the optical system arranged therebehind—if modifications are made thereto, the sought function is no longer guaranteed.

Furthermore, blurred light-dark boundaries are necessary for legal reasons, and therefore HD lines are mapped neither too sharply, nor in a manner merged excessively with one another, i.e. the maximum sharpness of the HD line is defined by legal provisions. A blurring of this type of the HD line means that the HD line is perceived by the driver as "softer" and subjectively more comfortably.

This HD transition is quantified by the maximum of a gradient along a vertical section through the light-dark boundary. For this purpose, the logarithm of the illumination intensity is calculated at measurement points distanced by 0.1°, and the difference thereof is formed, whereby the gradient function is obtained. The maximum of this function is referred to as the gradient of the HD boundary. Since this definition only imprecisely replicates the human brightness perception, differently perceived HD lines may have the same measured gradient value, or different gradients may be measured with HD lines that look similar.

Gradient softening is usually implemented by changing the lens surface of a lens of a lighting device. In accordance with the prior art different solutions are common: By random roughening of the lens surface, a softer HD boundary can be achieved by way of example, however this results in a dazzling of oncoming road users. In other variants a modulation (for example superimposition of two sine waves, small indentations in the form of spherical portions, etc.) is applied to the lens surface. Solutions of this type are heavily dependent on the flow of light distribution through the lens, and changes of this type, for example by variation of the lighting technology, then have a significant and in part negative effect on the flow of light distribution produced.

Another subject is the production of segmented light distributions. These are used for example in the production of dynamic light distributions, for example of a dynamic main beam distribution. In specific embodiments a dynamic light distribution of this type is constructed from a number of individual light distributions. For this purpose, a small segment in the light pattern is produced by way of example using individual light sources, each of which is assigned an optical attachment, and the superimposition of these light segments then gives the overall light distribution. By switching off individual light sources, individual segments in the light pattern can be switched off, i.e. not lit. Here, the segments are usually arranged in rows and columns.

In principle, it is possible to map the individual light segments with sharp delimitation edges and to take measures to ensure that adjacent light segments do not border one another directly. This has the advantage that in "full light" operation, i.e. with activation of all light segments, no dark regions ("grids") can be seen between the light segments. However, a disadvantage lies in the fact that when one or more light segments are switched off, the light distribution in these regions has a sharp light-dark boundary, which is found to be annoying and additionally leads quickly to fatigue.

Another approach lies in allowing the light segments to be arranged in a manner not directly bordering one another. It has been found to be problematic with light distributions of this type that undesirable light effects naturally occur here in the region of the segments bordering one another, and in particular fluctuations in brightness occur in this region, which may be found to be annoying by a vehicle driver.

In addition, there is generally also still the problem of the sharp light-dark boundary in this case.

The described disadvantages of the prior art are to be overcome. The object of the invention is therefore to provide a refractive optical component with which a light pattern can be provided which satisfies the legal values and at the same time is not considered to be bothersome.

This object is achieved in accordance with the invention with an optical structure of the type mentioned in the introduction in that the optical structure is associated with the lighting device in such a way or is part of the lighting device in such a way that substantially the entire flow of light from the lighting device passes through the optical structure, and wherein the unmodified light distribution produced by the lighting device is modified by the optical structure into a predefinable, modified light distribution, wherein the modified light distribution is formed by convolution of the unmodified light distribution with a scattering function, and wherein the optical structure is designed in such a way that the unmodified light distribution is modified according to the scattering function.

In accordance with the invention the entire optical structure is thus considered, and this is modified or modeled accordingly via a scattering function in such a way that the complete desired light pattern is provided. In contrast with the prior art, where, by way of example, in order to generate the gradient softening and signlight, different structural elements on an optical structure are used or some of the existing structural elements are additionally also modified, in accordance with the present invention the desired (modified) light distribution, starting from an unmodified light distribution produced with the lighting device without optical structure, is provided in that the unmodified light distribution is convoluted with such a scattering function, the desired light distribution is provided, and the optical structure in its entirety is then modeled in such a way that it modifies the entire flow of light of the lighting device in such a way that a modified light distribution corresponding to the scattering function is produced from the unmodified light distribution.

Here, in accordance with a specific embodiment, the optical structure consists of a multiplicity of optical structural elements, which structural elements have a light-scattering effect.

Here, the structural elements are preferably distributed over at least one, preferably precisely one defined area of at least one, preferably precisely one optics element.

It is particularly advantageous when the optical structural elements are formed in such a way that each structural element modifies the light bundle passing through the structural element into a modified light bundle according to the scattering function.

Under consideration of a certain (unmodified) light bundle from the entire flow of light, this thus makes a certain contribution to the light distribution in the light pattern (the entire flow of light produces the (overall) light distribution). A structural element now modifies a light bundle passing through the structural element in such a way that the unmodified contribution to the overall light distribution is altered according to the scattering function. By way of example, the unmodified light bundle produces a light distribution contribution having a certain form, i.e. certain regions on the roadway or on a measuring screen are lit, other regions are unlit. Due to the structural element, regions outside the originally lit region are now also lit with a certain intensity according to the scattering function, whereas—since the overall flow of light remains constant—the intensity is reduced at least in parts of the region originally lit with the unmodified light bundle.

In accordance with one embodiment of the invention the optical structure is arranged on at least one, preferably precisely one boundary surface of an optics element, which is formed in the manner of a diffusing plate or in the manner of a covering plate of the lighting device.

The "defined area" mentioned in the introduction thus lies on at least one, preferably precisely one boundary surface of an optics element, which is formed as a diffusing plate or covering plate.

In another embodiment the optical structure is arranged on at least one surface of an optics element in the form of a lens, in particular a projection lens of the lighting device.

The "defined area" thus lies on a surface of a lens.

Here, the optical structure is preferably arranged on the light exit side of the lens.

The optical structure is thus preferably arranged on the curved light exit face of the lens, preferably of the projection lens.

It is of particular advantage when the structural elements of the optical structure are distributed over the entire at least one surface of an optics element.

The "defined area" is thus formed by the entire surface or boundary surface of the optics element.

It is also of particular advantage when all structural elements are substantially identical.

Each structural element modifies the flow of light passing therethrough in a manner identical to all other structural elements.

Here, "substantially" identical means that in the case of a planar surface, on which the structural elements are arranged, these are actually identical.

In the case of curved surfaces the structural elements are formed identically in the central region, whereas the edge regions of different structural elements may differ (slightly) from one another by the curvature of the surface.

In a specific embodiment all structural elements are accordingly identical in respect of a planar surface or a surface intended to be planar.

The structural elements are calculated accordingly for a planar surface; if these identical structural elements thus calculated—with identical orientation—are placed on a curved surface, for example of a lens, the structural elements are thus still mapped identically in their central region, as already mentioned above; in the regions of transition to the original lens surface, on which the structural elements are placed, the structural elements have a different shape however depending on the position on the lens surface on account of the curvature of the lens surface, which with the small size of the structural elements results in no or only very slight effects on the light distribution.

It is also advantageous when all structural elements are identically oriented.

With a planar defined area no further explanations are necessary. With curved surfaces (for example: lens), the structural elements are arranged identically along axes through the surface, which axes extend parallel to an axis of symmetry or to an optical axis of the surface (and not normal to the surface normal).

This has manufacturing advantages in particular, since the optical structure and the tool for producing the structure can be easily removed in this way, since no undercuts can form on the optical structure.

An optical structure according to the invention can be produced optimally when the scattering function (PSF) is a point-spread function.

It is also advantageous if the symmetry of a structural element is dependent on the symmetry of the scattering function PSF. The structural element generally has the same class of symmetry as the PSF. If, by way of example, the PSF is mirror-symmetrical horizontally, the structural element thus also has a horizontal mirror symmetry.

The dimensions of a structural element, for example a diameter and/or a height of the structural element, are advantageously also greater, in particular much greater than the wavelength of visible light, and therefore diffraction effects can be avoided.

Here, the height of the structural elements advantageously lies in particular in the μm range.

By way of example, the height of the structural elements lies in the range of 0.5-5 μm, wherein the height of the structural elements preferably lies in the range of 1-3 μm.

In a specific embodiment the height of the structural elements is approximately 2.7 μm.

In a specific embodiment, for example in variants having the above-described heights, the diameter or a length of the structural elements also lies in the millimeter range.

By way of example, the diameter or a length of the structural elements lies between 0.5-2 mm, wherein the diameter or a length of the structural elements is approximately 1 mm.

In an exemplary embodiment of a lens on which the structural elements are arranged the diameter of the lens is 90 mm.

In addition, the structural elements may have a circular cross section at their base. With a curved defined area over which the structural elements are arranged, the projection of the base—that is the area over the defined area occupied by a structural element—is considered here in a plane.

Structural elements are thus preferably substantially rotationally symmetrical, but can have different deformations depending on the application, i.e. can have deviations from this rotationally symmetrical structure, wherein these deformations can be formed over a large area, generally from locally.

An optical structure can be produced easily when the defined area on which the structural elements are distributed is divided in a—virtual—preferably regular grid structure, and wherein the structural elements are arranged at the grid points or between the grid points of the grid structure.

Such an arrangement is advantageous in particular also in respect of an optimal optical effect of the optical structure, since the optical effect of the optical structure can thus be adjusted in an optimal manner.

The "regularity" of the structure is to be considered here, in the case of a curved optical area over which the optical structure is arranged, in respect of a projection of this defined area into a plane, wherein—on account of the short grid spacing—the grid can be considered as planar even with a curved defined area in the region of adjacent grid points.

Precisely one structural element is preferably arranged at each grid point or between the grid points of the grid structure.

In addition, adjacent structural elements can transition into one another, i.e. are arranged in contact with one another, or the structural elements are isolated from one another, i.e. do not contact one another.

In accordance with a preferred embodiment of the invention the grid structure forms a hexagonal grid.

In this way an optimal filling of the defined area can be achieved, in particular with structural elements having a round base, such that approximately 87% of the defined area is covered by structural elements and merely approximately 13% of unmodified area is present.

In accordance with a specific embodiment of the invention adjacent grid points are arranged at a distance of approximately 0.5-2 mm, preferably approximately 1 mm, from one another.

In principle, in another embodiment, the structural elements can also be distributed randomly, for example pseudo-randomly, over the defined area.

From an optical viewpoint it is optimal when the transition of the structural elements to the defined area is continuous, preferably C2 continuous, i.e. is implemented with continuous tangents.

An above-described optical structure is particularly well suited for a lighting device which is designed to map the light radiated therefrom in the form of a dimmed light distribution, in particular a dipped beam distribution, wherein the dimmed light distribution, in particular the dipped beam distribution, has a light-dark boundary, wherein, in accordance with the invention, the optical structure, in particular the structural elements, is/are formed in such a way, or the scattering function is designed in such a way, that the gradient of the light-dark boundary of the—unmodified—light distribution of the lighting device is reduced.

The "softness" of the transition, as described in detail in DE 10 2008 023 551 A1 and repeated here in part, is horizontally described by the maximum of the gradient along a vertical section through the light-dark boundary at −2.5°. For this purpose the logarithm of the illumination intensity is calculated at measurement points distanced vertically from one another by 0.1°, and the difference thereof is formed, whereby what is known as the gradient function is obtained. The maximum of the gradient function is referred to as the gradient of the light-dark boundary. The greater is this gradient, the sharper is the light-dark transition. The vertical position of the maximum of this function also describes the location at which the 'light-dark boundary' is identified, i.e. the point at which the human eye perceives a boundary line between "light" and "dark" (for example at −0.5° vertically).

A lighting device produces—without optical structure according to the invention—a dipped beam distribution having a light-dark boundary with a certain sharpness, described by what are known as the "gradients". By providing an optical structure according to the invention, this—unmodified—light distribution is modified in such a way that the sharpness of the light-dark boundary is reduced, and therefore it meets the legal requirements and is perceived comfortably by the human eye.

An optical structure according to the invention is also advantageous for a lighting device, which lighting device is designed to map the light radiated therefrom in the form of a dimmed light distribution, in particular a dipped beam distribution, wherein the dimmed light distribution, in particular the dipped beam distribution, has a light-dark boundary, wherein, in accordance with the invention, the optical structure, in particular the structural elements, is/are formed in such a way, or the scattering function is designed in such a way, that a portion of the flow of light of the lighting device is mapped into a region above the light/dark boundary.

In this way, a signlight as described in the introduction can be produced in an optimal manner with the optical structure according to the invention, in that for example each optical structural element deflects a small part of the flow of light passing through the structural element into a corresponding region.

It is advantageous in particular that, with an optical structure according to the invention, both the gradient of the light-dark boundary can be adjusted and a signlight can be produced. In the prior art two optical structures are necessary for this purpose, wherein a first structure for producing one of the two optical "effects" is superimposed by a second structure, which produces the second optical "effect". With the optical structure according to the invention, this is achieved by a structure consisting of substantially identical structural elements, which are designed in order to "provide" a scattering function as described above.

In accordance with a specific embodiment the flow of light deflected by the optical structure lies in a region between 1.5° and 4°, in particular between 2° and 4°, above the HD line.

In accordance with an exemplary embodiment of the invention approximately 0.5%-1% of the flow of light of the lighting device is deflected by the optical structure into a region above the light-dark boundary.

An optical structure according to the invention is also advantageous for a lighting device, which lighting device is designed to map the light radiated therefrom in the form of individual light distributions mapped in n rows and m columns, wherein $n>1$, $m\geq1$ or $n\geq1$, $m>1$, and which individual light distributions together form an overall light distribution, for example a full beam light distribution, wherein, in accordance with the invention, the optical structure, in particular the structural elements, is/are formed in such a way, or the scattering function is designed in such a way, that at least some of the flow of light of the lighting device is deflected into the boundary regions, in each of which two individual light distributions are arranged adjacently to one another.

The "construction" of an overall light distribution from individual light distributions has the advantage that, for example as described above, certain regions can be masked out by masking out individual light segments (individual light distributions). For this purpose it is advantageous when the individual light distributions are bordered comparatively sharply, however this results in the disadvantage that an optical grid structure may be formed, with dark or darkened regions between the light segments, which can be considered optically annoying and in some circumstances also may not be legally compliant.

With the invention it is possible in a simple manner to radiate sufficient light into these dark or darkened regions between the light segments, such that this grid structure is no longer visible.

It is advantageous in particular when adjacent individual light distributions of the unmodified light distribution are arranged at a defined distance or defined distances from one another.

In accordance with a specific embodiment the individual light distributions of the unmodified light distribution have a rectangular or square shape, in particular with a projection onto a vertical plane.

In particular, all distances between adjacent individual light distributions are identical in a horizontal direction.

Furthermore, alternatively or preferably additionally, all distances between adjacent individual light distributions are identical in a vertical direction.

In accordance with a specific embodiment the individual light distributions have a width and/or a height of approximately 1°.

The distance between two adjacent individual light distributions is typically less than 0.5° and greater than 0°.

By way of example, the distance between two adjacent individual light distributions is less than 0.2°.

For example, the distance between two adjacent individual light distributions lies between 0.05° and 0.15°.

Furthermore, the distance between two adjacent individual light distributions is less than or equal to 0.1°.

In a specific embodiment the average light intensity in a gap between two individual light distributions, produced with the flow of light intended for an individual light distribution, corresponds to half the average light intensity in an adjacent individual light distribution of the modified light distribution, and therefore the overall light intensity with light intended for the two adjacent individual light distributions corresponds substantially to the individual light distributions of the modified light distribution.

The light intensity in all individual light distributions is preferably substantially identical here, and the intensity in the individual light distributions is also advantageously substantially homogeneous over the entire area of the individual light distribution.

As already mentioned above, it is particularly advantageous when part of the flow of light which produces exclusively one individual light distribution without optical structure is deflected by the optical structure into the gap regions framing this individual light distribution, which gap regions are provided as a result of the distancing of the individual light distributions from one another.

The dark edge regions around the individual light distributions are thus lit up exclusively by light from individual light distributions bordering these edge regions, such that when separate individual light distributions are switched off, the switched-off regions still appear dark in the overall light pattern and are not lit by scatter light "from" other individual light distributions.

Proceeding from a considered individual light distribution, the light intensity in an adjacent gap preferably decreases in the direction of the adjacent individual light distribution, wherein the decrease is preferably linear.

Once a gap is lit by part of the light intended for the two adjacent individual light distributions (in the crossing region of the gaps, part of the light from four individual light distributions), an approximately constant light intensity is provided over the entire gap—in particular with a linear profile of the intensity.

In particular, the light intensity decreases to zero.

In addition, the light intensity in a gap directly adjacent to the edge of the considered individual light distribution advantageously corresponds substantially to the light intensity of the individual light distribution of the modified light distribution at the edge thereof or to the average light intensity in the individual light distribution of the modified light distribution.

It is generally advantageous when the optical structure is arranged and/or formed in such a way that substantially the entire, preferably the entire flow of light of the lighting device impinges on the optical structure.

In this way the entire flow of light can be used for the modification of the original light distribution.

It is advantageous in particular if the optical structure is arranged and/or formed in such a way that it is lit up substantially homogeneously.

Lastly, the invention also relates to a lighting device comprising at least one, preferably precisely one optical structure as described above.

By way of example, the lighting device is a projection system.

In this case the lighting device preferably comprises at least one light source, at least one reflector, and at least one lens, in particular a projection lens, wherein the at least one optical structure is preferably arranged on the lens and/or an additional covering or diffusing plate.

The lighting device may also be a reflection system.

Here, it is advantageous if the lighting device comprises at least one free-form reflector and at least one light source and at least one diffusing plate and/or at least one covering plate, and wherein the at least one optical structure is advantageously arranged on the at least one diffusing plate and/or the at least one covering plate and/or an additional covering or diffusing plate.

The invention also relates to a method for producing an above-described optical structure, in which method the modified light distribution is modified by convolution of the unmodified light distribution with a scattering function, and wherein the optical structure is designed in such a way that the unmodified light distribution is modified according to the scattering function.

By way of example, in the method the optical structural elements are designed in such a way that each structural element modifies the light bundle passing through the structural element into a modified light bundle according to the scattering function.

By way of example, in the method the scattering function is a point-spread function.

In an above-mentioned method for producing an optical structure for a lighting device, which lighting device is designed to map the light radiated therefrom in the form of a dimmed light distribution, in particular a dipped beam distribution, wherein the dimmed light distribution, in particular the dipped beam distribution, has a light-dark boundary, the optical structure, in particular the structural elements, can be formed in such a way, or the scattering function can be designed in such a way, that the gradient of the light-dark boundary of the—unmodified—light distribution of the lighting device is reduced.

In an above-mentioned method for producing an optical structure for a lighting device, which lighting device is designed to map the light radiated therefrom in the form of a dimmed light distribution, in particular a dipped beam distribution, wherein the dimmed light distribution, in particular the dipped beam distribution, has a light-dark boundary, the optical structure, in particular the structural elements, can be formed in such a way, or the scattering function can be designed in such a way, that a portion of the flow of light of the lighting device is mapped into a region above the light/dark boundary.

In an above-mentioned method for producing an optical structure for a lighting device, which lighting device is designed to map the light radiated therefrom in the form of individual light distributions mapped in n rows and m columns, wherein n>1, m≥1 or n≥1, m>1, and which individual light distributions together form an overall light distribution, for example a full beam light distribution, the optical structure, in particular the structural elements, can be formed in such a way, or the scattering function can be designed in such a way, that at least some of the flow of light of the lighting device is deflected into the boundary regions, in each of which two individual light distributions are arranged adjacently to one another.

The advantageous embodiments discussed further above also apply analogously in conjunction with the method according to the invention.

Figure 2:
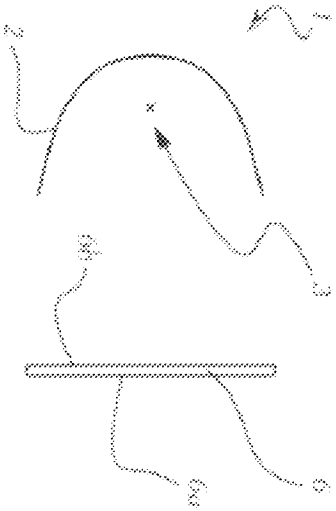
Fig. 2 (Prior Art)
Figure 3:
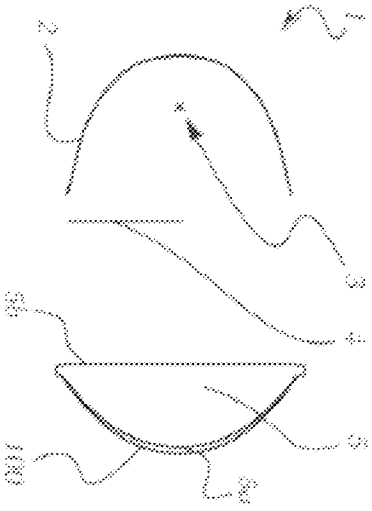
Figure 4:
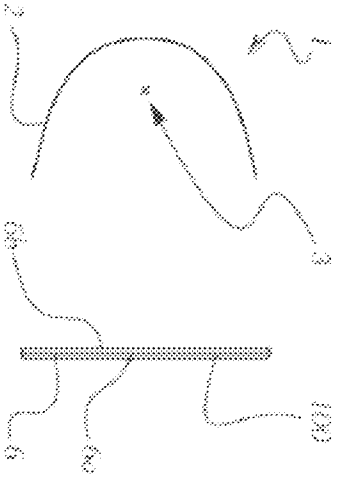
Figure 5:
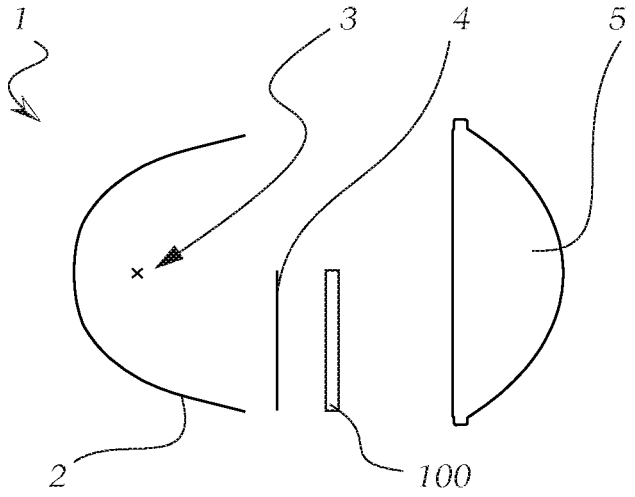
Figure 6:
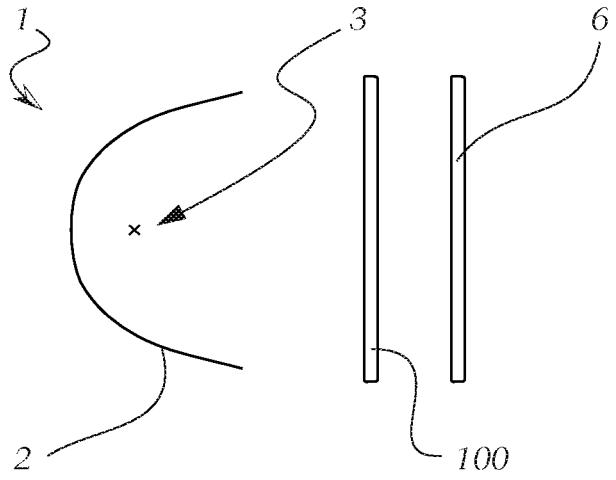
Figure 7:
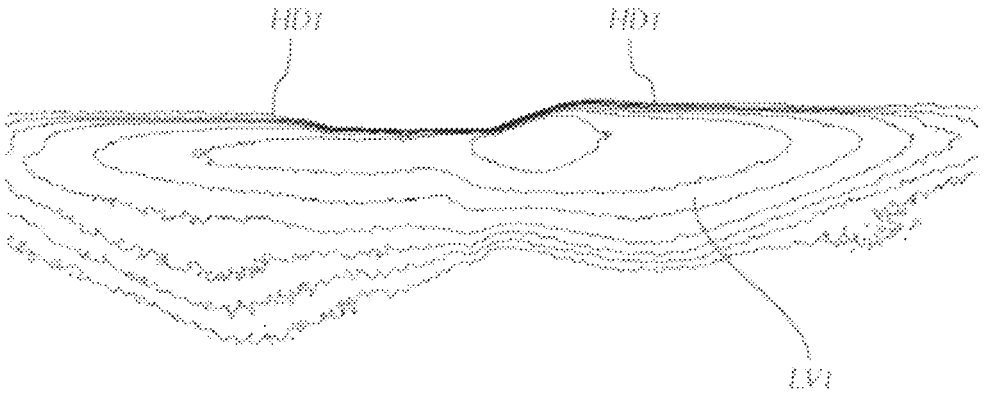
Fig. 7 (Prior Art)
Figure 7A:
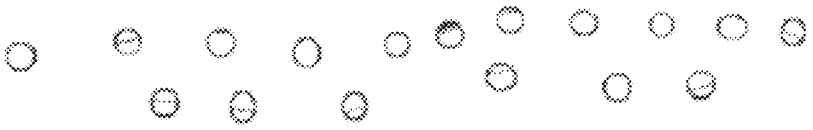
Fig. 7a (Prior Art)
Figure 7B:
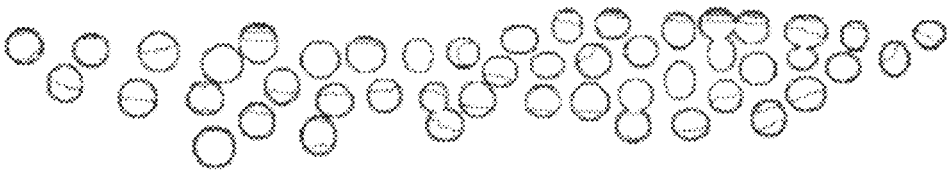
Fig. 7b (Prior Art)
Figure 8:
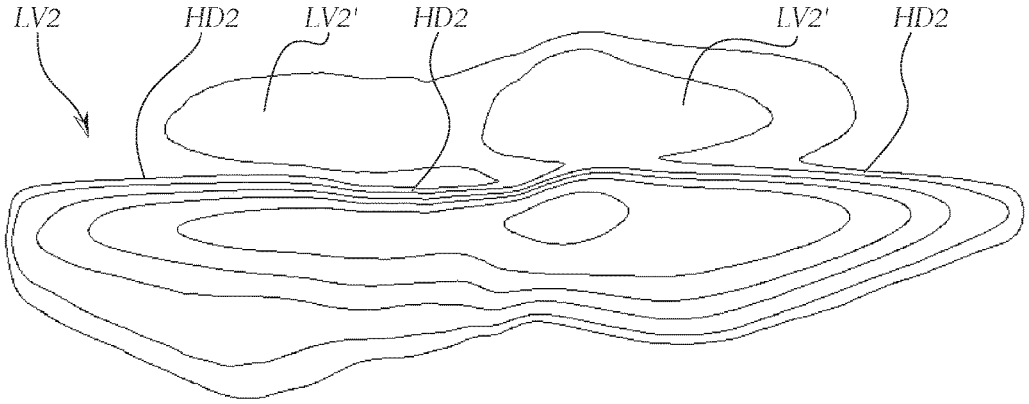
Figure 8A:
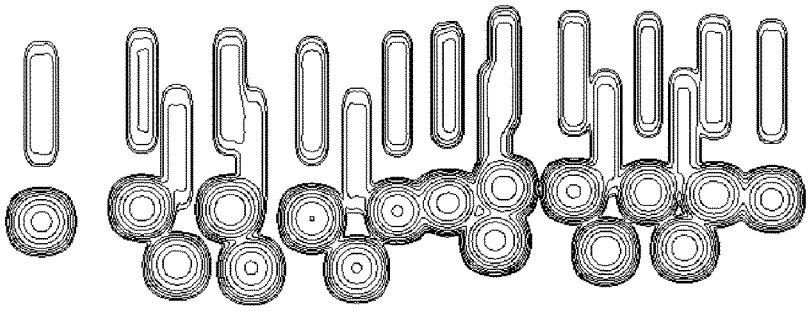
Figure 8B:
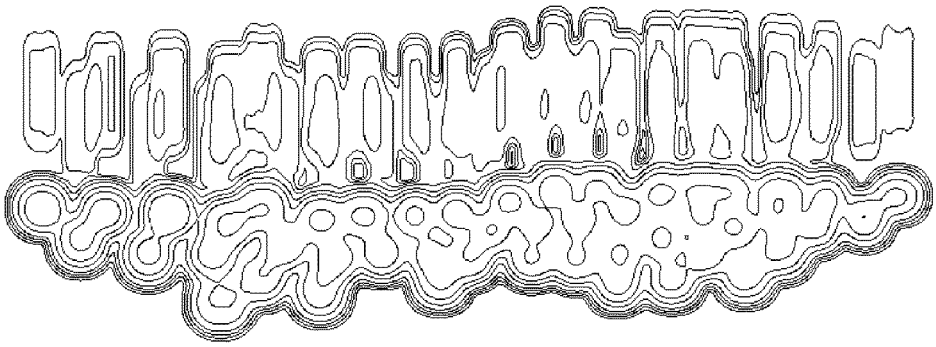
Figure 9:
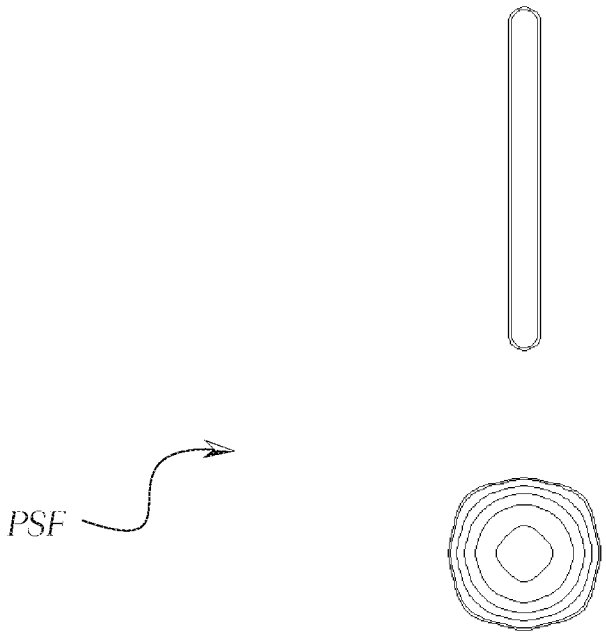
Figure 10B:
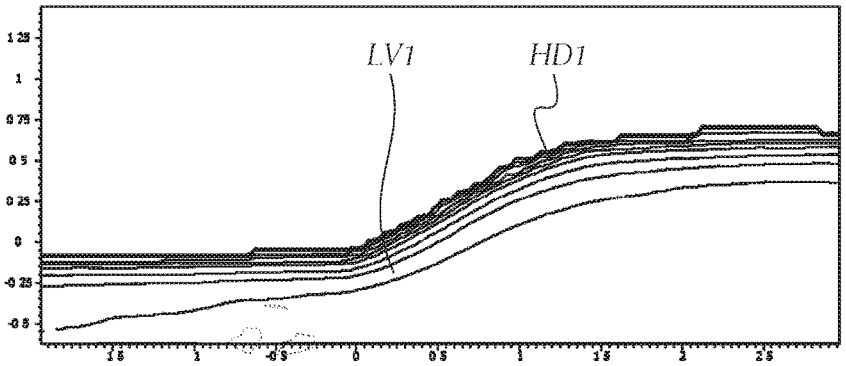
Figure 10A:
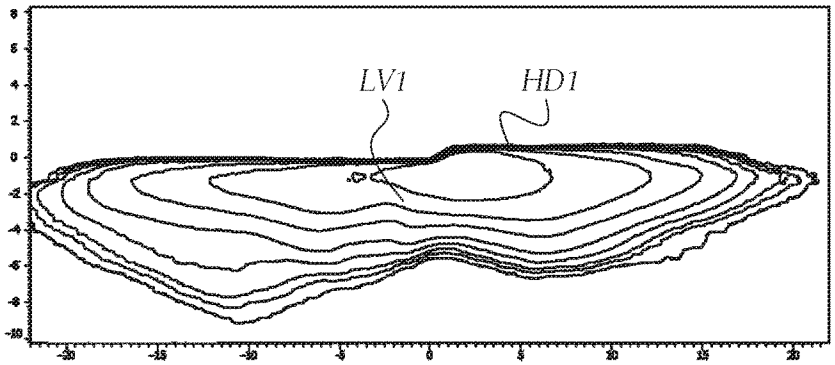
Figure 10:
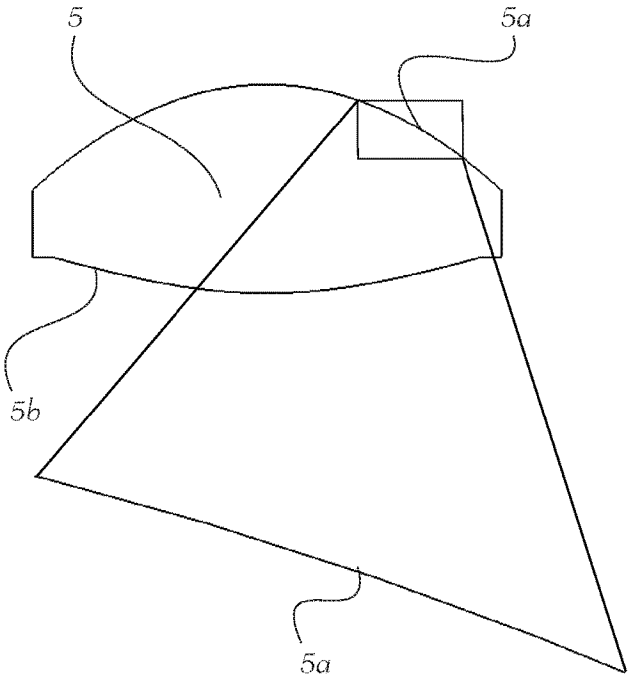
Figure 11B:
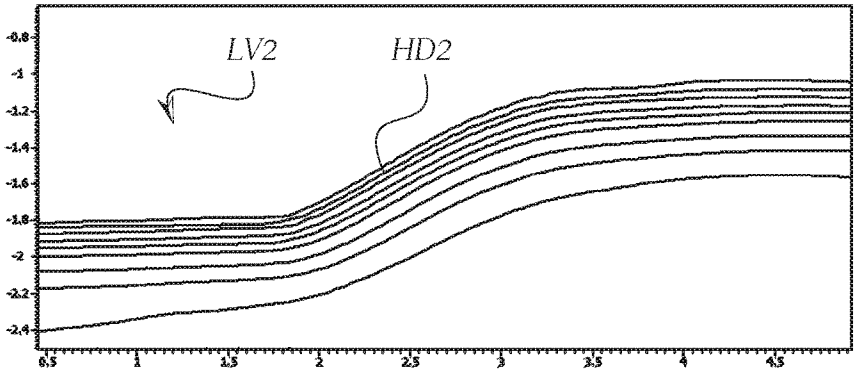
Figure 11A:
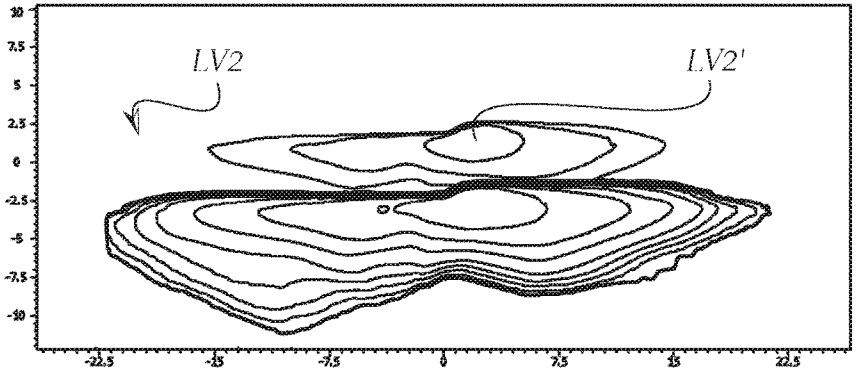
Figure 11:
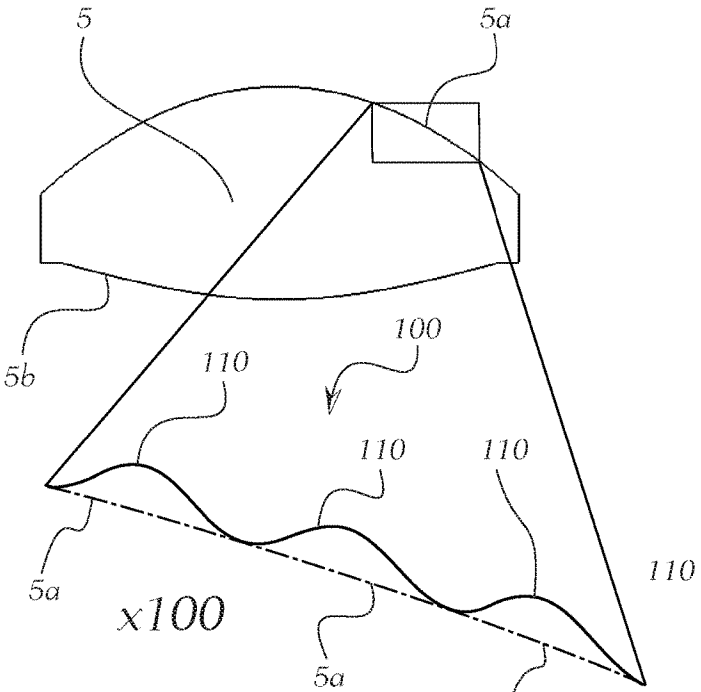
Figure 12:
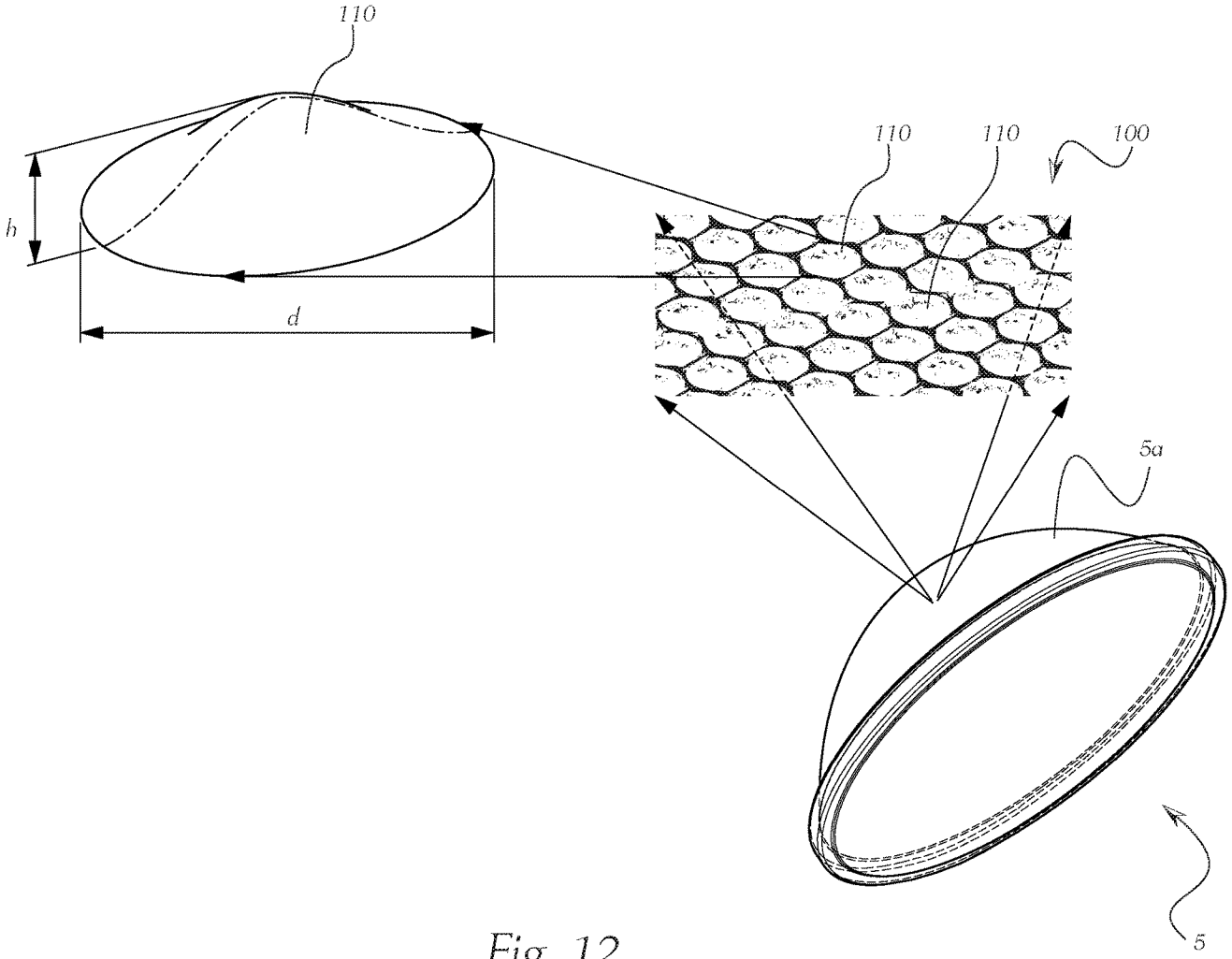
Figure 14:
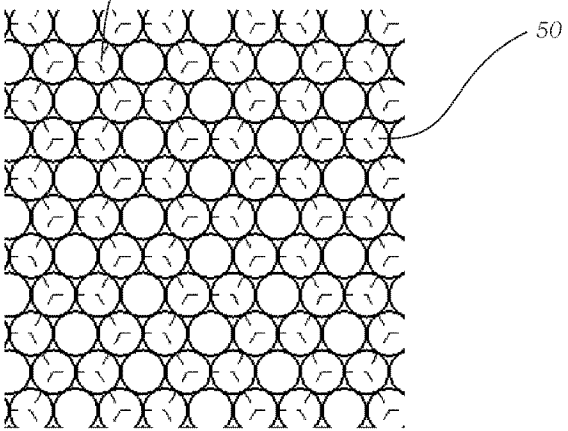
Figure 13:
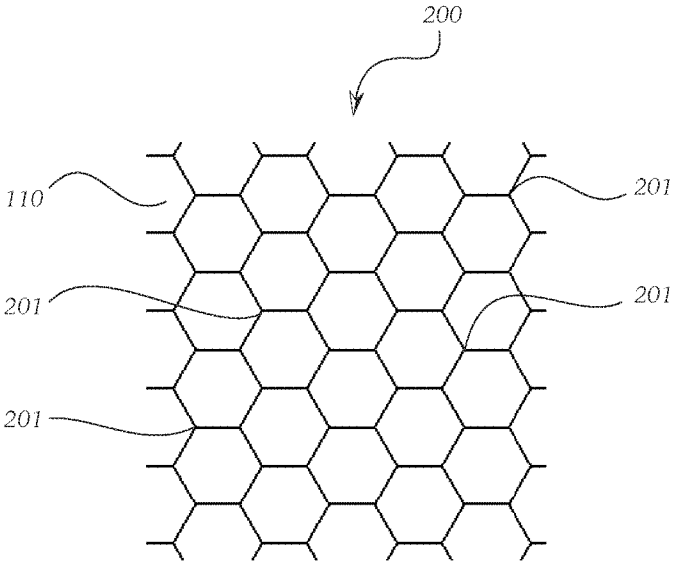
Figure 15:
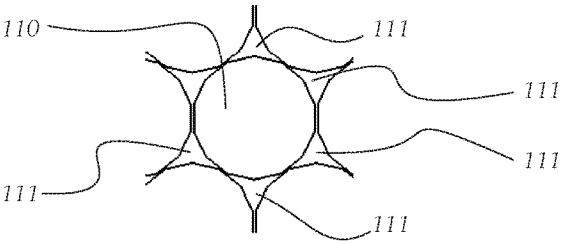
Figure 17:
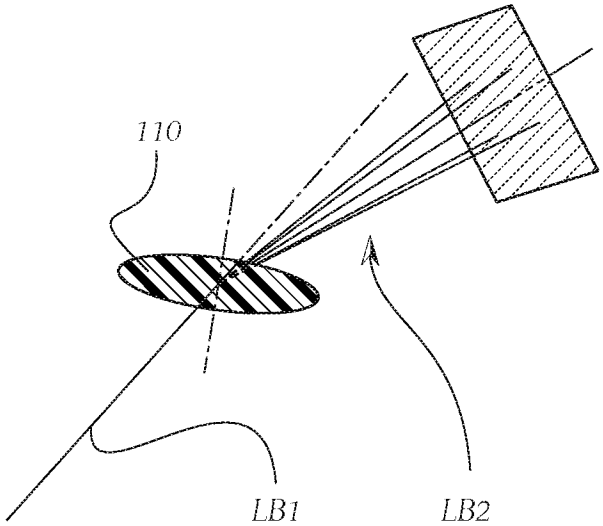
Figure 16:
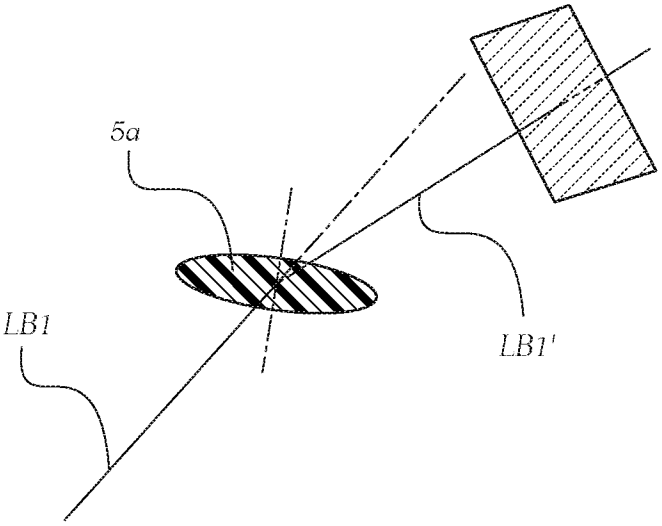
Figure 18:
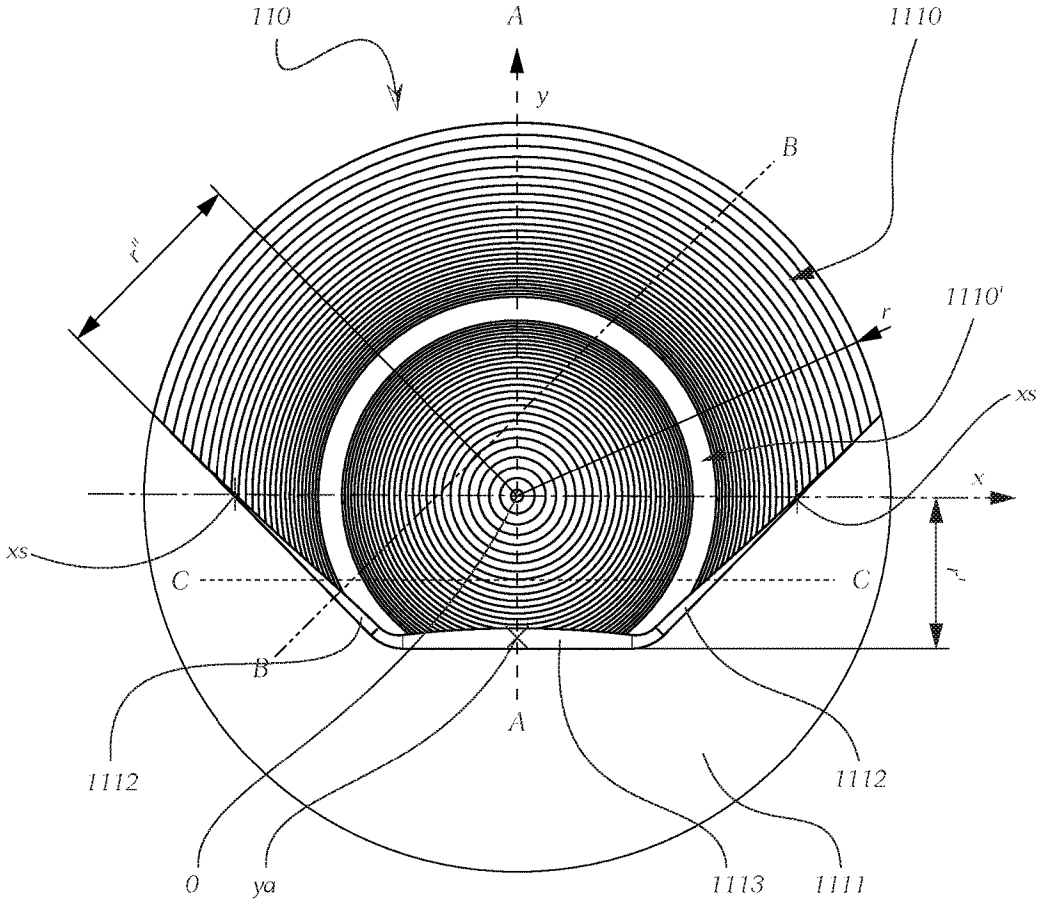
Figures 18A, 18B, 18C:
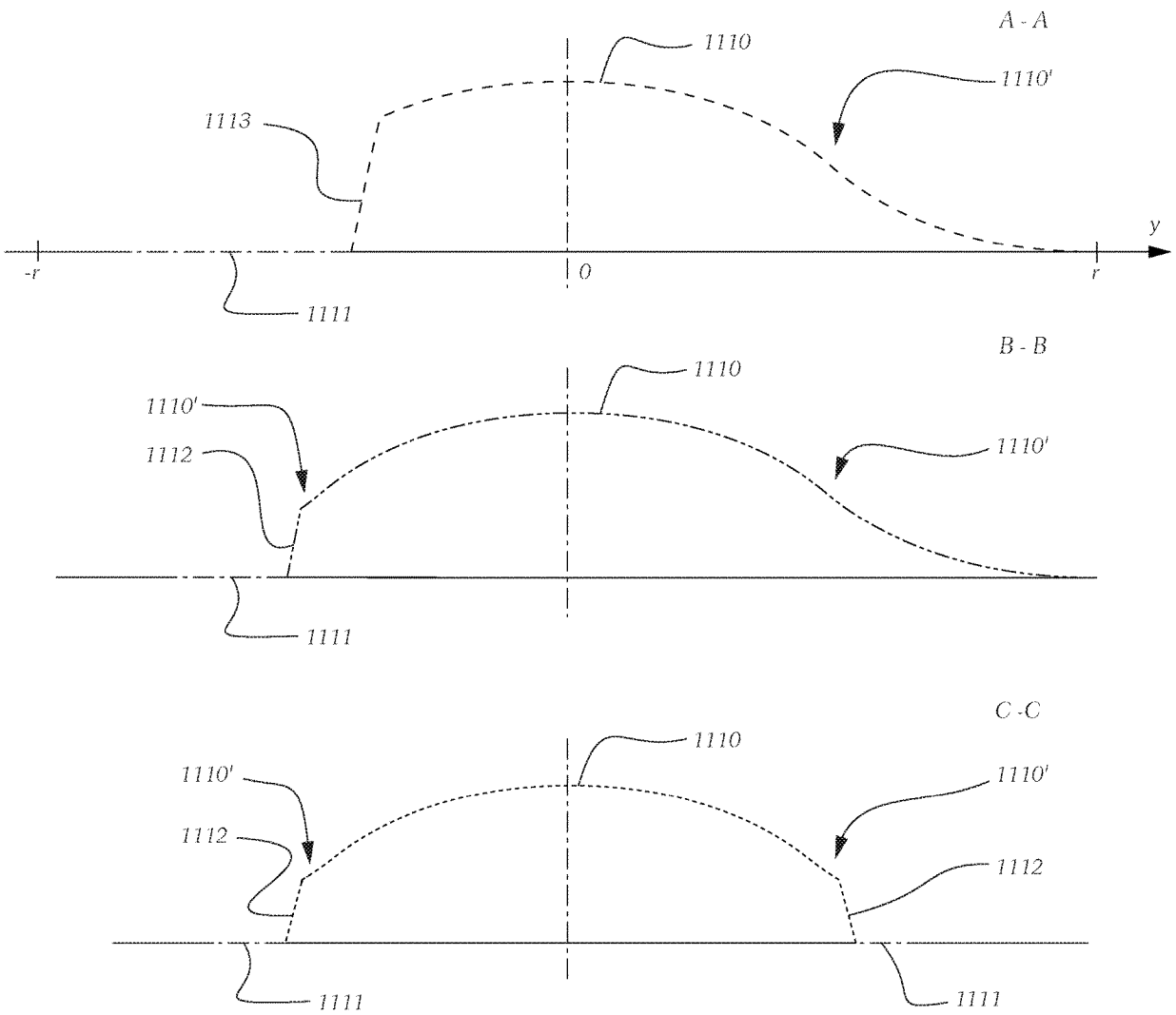
Figure 19:
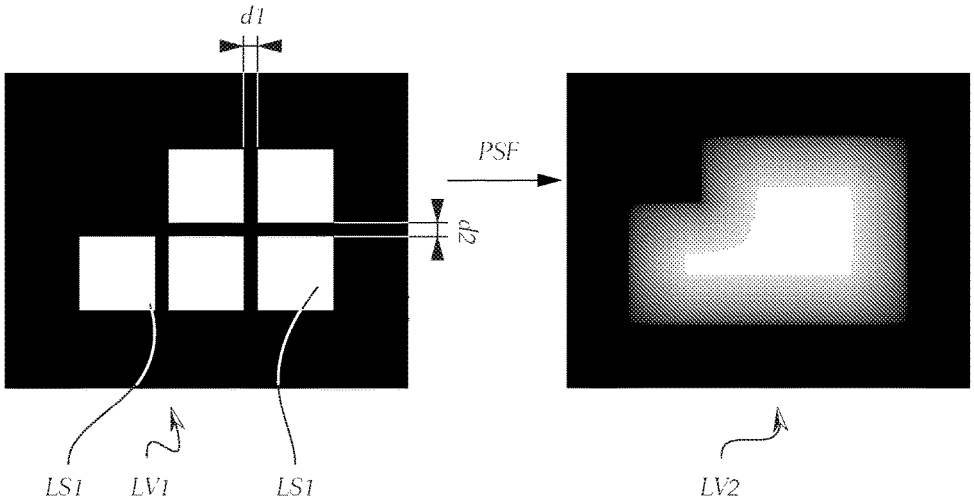
Figure 20:
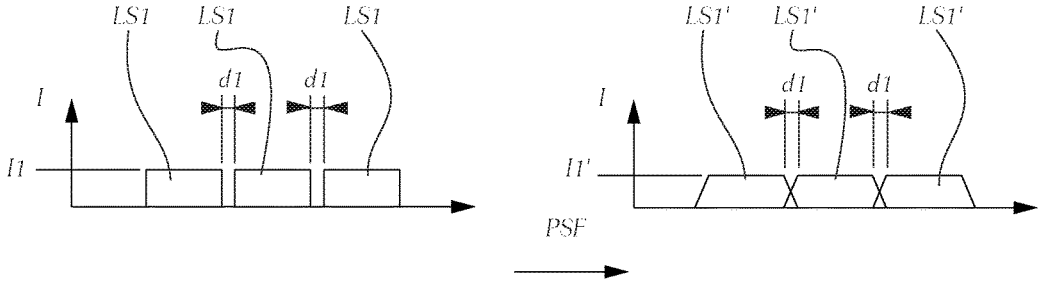

The invention is discussed hereinafter in greater detail on the basis of the drawing, in which:

FIG. 1 shows a schematic illustration of a projection module according to the prior art, FIG. 2 shows a schematic illustration of a reflection model according to the prior art, FIG. 3 shows a schematic illustration of a projection module comprising an optical structure according to the invention on the outer side of a lens, FIG. 4 shows a schematic illustration of a reflection module comprising an optical structure according to the invention on the outer side of a covering or diffusing plate, FIG. 5 shows a schematic illustration of a projection module comprising an optical structure according to the invention on an additional optics element, such as a plate, FIG. 6 shows a schematic illustration of a reflection module comprising an optical structure according to the invention on an additional optics element, such as a plate, FIG. 7 shows a "conventional" unmodified dipped beam distribution produced using a lighting device according to the prior art, FIG. 7*a* shows individual light flecks produced with regions of a lighting device according to the prior art, FIG. 7*b* shows a greater number of light flecks as illustrated in FIG. 7*a*, FIG. 8 shows a modified dipped beam distribution produced using a lighting device comprising an optical structure according to the invention, FIG. 8*a* shows the light flecks from FIG. 7*a*, modified according to a scattering function for combined gradient softening and production of a signlight, FIG. 8*b* shows the light flecks from FIG. 7*b*, modified according to the scattering function, FIG. 9 shows an individual light fleck from FIG. 7*a* or 7*b*, modified using a scattering function for combined gradient softening and production of a signlight, FIG. 10 shows a lens from a projection module according to the prior art and an enlarged portion of the profile of the contour of the outer side of this lens, FIG. 10 *a* shows a schematic illustration of a dipped beam distribution, produced using a lighting device comprising a lens from FIG. 10, FIG. 10*b* shows a schematic illustration of the dipped beam distribution from FIG. 10*a* in the region of the asymmetry portion of the light-dark boundary, FIG. 11 shows a lens from a projection module comprising an optical structure according to the invention on the outer side of the lens together with an enlarged illustration of a detail of the contour of the outer side, FIG. 11 *a* shows a schematic illustration of a dipped beam distribution, produced using a lighting device comprising a lens from FIG. 11, FIG. 11*b* shows a schematic illustration of the dipped beam distribution from FIG. 11*a* in the region of the asymmetry portion of the light-dark boundary, FIG. 12 shows a lens comprising an optical structure according to the invention in a three-dimensional view, a detail of the lens in enlarged illustration, and also a further enlarged detail of the already enlarged detail, FIG. 13 shows a hexagonal grid structure, FIG. 14 shows the grid structure from FIG. 13, occupied by optical structural elements, FIG. 15 shows the optical structure from FIG. 14 in an enlarged illustration in the region of an optical structural element, FIG. 16 shows the beam path of an individual beam through an unmodified optical structure, for example through a region of an outer surface of an unmodified lens, FIG. 17 shows the beam path through the surface element from FIG. 16, now with modified optical structure according to the invention, FIG. 18 shows a plan view of an optical structural element of an optical structure according to the invention with schematic contour lines, FIG. 18*a* shows the optical structural element from FIG. 18 in a section along the line A-A, FIG. 18*b* shows the optical structural element from FIG. 18 in a section along the line B-B, and FIG. 18*c* shows the optical structural element from FIG. 18 in a section along the line C-C, FIG. 19 shows an unmodified light distribution constructed from square light segments and the mapping of the flow of light forming this light distribution by means of an optical structure comprising square structural elements, and FIG. 20 shows the schematic profile of the light intensity in an unmodified and a modified light distribution.

Hereinafter, reference will be made first to FIGS. 1-6, which—without limitation of the subject matter for which protection is sought—show fundamental possibilities of the arrangement of an optical structure according to the invention. An optical structure according to the invention may also be used in lighting devices other than the lighting devices for motor vehicles presented here.

FIG. 1 schematically shows a lighting device 1 in the form of a projection system, comprising a reflector 2, a light source 3, a (optional) screen arrangement 4, and a projection lens 5, having a curved outer side 5*a* and a planar inner side 5*b*.

FIG. 2 schematically shows a lighting device 1 in the form of a reflection system, comprising a reflector 2, a light source 3, and a diffusing or covering plate 6, the reference signs 6*a* and 6*b* denoting the outer side and the inner side of the plate 6.

FIG. 3 shows a schematic illustration of the projection system from FIG. 1, wherein an optical structure 100 according to the invention is arranged on the outer side of a lens 5. This optical structure 100 preferably occupies the entire outer side 5*a* of the lens 5 here.

FIG. 4 shows a schematic illustration of the reflection module from FIG. 2 comprising an optical structure 100 according to the invention on the outer side of the covering or diffusing plate 6, wherein the optical structure preferably occupies the entire outer side of the plate 6.

FIG. 5 again shows a schematic illustration of a projection module 1 as illustrated in FIG. 1, comprising an optical structure 100 according to the invention on an additional optics element, such as a plate, wherein the optics element is arranged between the screen 4 and the lens 5.

FIG. 6 lastly again shows a schematic illustration of a reflection module from FIG. 2 comprising an optical structure 100 according to the invention on an additional optics element, such as a plate, which is arranged between the light source 3 and the diffusing or covering plate 6.

As already mentioned, these illustrations serve merely to explain some of the possibilities of the arrangement of an optical structure 100 according to the invention. In principle, a lighting device may also have a plurality of light sources, for example may have LEDs as light sources, and the light-shaping body may be provided in the form of one or more light guides, reflectors, etc.

It is generally true that the optical structure 100 of the lighting device 1 is associated with or is part of the lighting device 1 in such a way that substantially the entire (or the entire optically relevant) flow of light from the lighting device 1 passes through the optical structure 100.

It is advantageous in particular when the optical structure is arranged and/or formed in such a way that it is lit up homogeneously. In this case, for the calculation of the optical structure, the extent to which different fractions of the overall area should be refractive can be easily derived from the scattering function.

FIG. 7 schematically shows a "conventional" unmodified dipped beam distribution LV1, as produced for example using a known lighting device 1 according to the prior art as shown in FIG. 1. The dipped beam distribution LV1 has a light-dark boundary HD1, which in the present case has an asymmetric profile.

FIG. 7*a* shows, for improved explanation of the effect of an optical structure 100 according to the invention, individual light flecks removed from the light distribution LV1, and FIG. 7*b* shows a greater number of such light flecks.

Under consideration now of FIG. 8, this shows a modified light distribution LV2, wherein this modified light distribution LV2 is created by modification of the original light distribution by means of the optical structure 100. The modified light distribution LV2 is produced here by convolution of the unmodified light distribution LV1 with a scattering function PSF, wherein the optical structure 100 is formed in such a way that the unmodified light distribution LV1 is modified into the new light distribution LV2 according to the scattering function PSF.

The modified light distribution LV2 here has substantially the same distribution form as the unmodified light distribution LV1 and also has a light-dark boundary HD2, which has a shallower gradient however, as indicated schematically by the greater distance between the Isolux lines in the region of the light-dark boundary. The light-dark boundary HD2 is thus "softer".

It can also be seen in FIG. 8 that a region LV2' above the light-dark boundary HD2 is also lit with a certain lighting intensity in order to generate a signlight.

A lighting device thus generates—without optical structure according to the invention—a dipped beam distribution LV1 having a light-dark boundary HD1 with a certain sharpness, described by what is known as the "gradient". By providing an optical structure 100 according to the invention, this—unmodified—light distribution LV1 is modified in such a way that the sharpness of the light-dark boundary is reduced, and therefore it satisfies the legal requirements and is perceived as comfortable by the human eye.

In addition, in the described embodiment, a proportion of the flow of light from the lighting device 1 is mapped into a region LV2' above the light-dark boundary HD2. In this way, a signlight described in the introduction can be produced in an optimal manner using the optical structure 100 according to the invention in that, by way of example, each optical structural element deflects a small proportion of the flow of light passing through the structural element into a corresponding region.

It is advantageous in particular that, with an optical structure according to the invention, both the gradient of the light-dark boundary can be adjusted and a signlight can be produced. Two optical structures are necessary for this purpose in the prior art, wherein a first structure for producing one of the two optical "effects" is superimposed by a second structure, which produces the second optical "effect". With the optical structure according to the invention, this is achieved by a structure consisting of substantially identical structural elements, which are designed to "provide" a scattering function as described above.

In a specific embodiment, as shown, the flow of light deflected by the optical structure lies here in a region LV2' between 1.5° and 4°, in particular between 2° and 4°, above the HD line.

In accordance with an exemplary embodiment of the invention 0.5%-1% of the flow of light from the lighting device 1 is deflected by the optical structure in a region LV2' above the light-dark boundary HD2.

Under consideration of FIGS. 8*a* and 8*b*, these show the individual light flecks as shown in FIGS. 7*a* and 7*b*, modified by an optical structure 100 according to the invention for gradient softening and simultaneous production of a signlight. As can be seen, the individual light flecks—at least in the region of the light-dark boundary—are smeared (softening), and at the same time a (smaller) part of the flow of light contributing without optical structure to the light flecks as shown in FIGS. 7*a* and 7*b* is deflected into a region above these light flecks in order to form a signlight.

FIG. 9 lastly shows in detail, again schematically, the influence of a scattering function for combined gradient softening and production of a signlight, which scattering function is preferably what is known as a point-spread function, as is used in FIG. 8, on an individual light fleck from FIG. 7*a* or 7*b*.

In accordance with the invention the entire optical structure 100 is thus considered, and this is modified or modelled accordingly via a scattering function in such a way that the entire desired light pattern LV2, LV2' is produced. In contrast with the prior art, where, by way of example, in order to generate the gradient softening and signlight, different structural elements on an optical structure are used or some of the existing structural elements are additionally also modified, in accordance with the present invention the desired (modified) light distribution, starting from an unmodified light distribution produced with the lighting device without optical structure, is provided in that the unmodified light distribution is convoluted with such a scattering function, the desired light distribution is provided, and the optical structure in its entirety is then modelled in such a way that it modifies the entire flow of light of the lighting device in such a way that a modified light distribution corresponding to the scattering function is produced from the unmodified light distribution.

In a preferred embodiment of the invention the optical structure 100 consists of a multiplicity of optical structural elements 110, which structural elements 110 have a light-scattering effect.

Under consideration firstly of FIG. 10, this shows a lens 5 as shown for example in FIG. 1. The following presentation is provided here on the basis of the lens, however substantially identical statements apply equally to a diffusing or covering plate, a separate component which carries the optical structure or forms this, etc.

The curved outer side 5*a* of the lens 5 is illustrated in an enlarged manner in FIG. 10 and the substantially smooth surface 5*a* can be seen. With the lens of this type without optical structure, a dipped beam distribution LV1 having a light-dark boundary HD1 as shown in FIGS. 10*a*, 10*b* is produced (see also FIG. 7).

FIG. 11 again shows the lens 5, now with an optical structure 100 consisting of a multiplicity of optical structural elements 110 on its outer side 5*a*. In the enlarged illustration of the outer side 5*a*, the structural elements 110 are enlarged or increased by a factor of 100 in order to be made visible. FIG. 11 here constitutes a purely schematic illustration.

With an optical structure 100 of this type comprising structural elements 110, a modified light distribution LV2 is produced, which forms a dipped beam distribution with light-dark boundary HD2 and signlight LV2' (FIGS. 11*a*, 11*b*).

The structural elements of the optical structure may be arranged in principle on the outer side and the inner side of the lens (or of a diffusing plate, etc.).

However, the structural elements 110 are preferably distributed over precisely one defined area 5*a* of an optics element, for example the outer side 5*a* of the lens 5 as illustrated. It is advantageous here when the structural elements 110 are distributed over the entire defined area 5*a*.

FIG. 12 as an example again shows the lens 5, which is already known and which on its outer side has an optical structure 100 consisting of individual structural elements 110. An individual structural element 110 having a diameter d and a height h is shown likewise schematically in FIG. 12.

It is of particular advantage when the optical structural elements 110 are formed in such a way that each structural element 110 modifies the light bundle LB1 passing through the respective structural element 110 into a modified light bundle LB2 according to the scattering function PSF. FIG. 16 shows the passage of a light beam or light bundle LB1 through a region on an unmodified lens surface 5*a* and the accordingly deflected light bundle LB1'. The light bundle LB1 is merely deflected here by the lens surface 5*a*, i.e. its direction is changed.

FIG. 17 again shows a light bundle LB1 which passes through a structural element 110 on a modified lens outer face. The exiting light bundle LB2 is on the one hand again deflected in terms of its direction, for example to the same extent as for the light bundle LB1', however a proportion of the flow of light of the light bundle is also scattered, as illustrated schematically in FIG. 17 on the basis of the light bundle LB2.

Under consideration of a certain (unmodified) light bundle LB1 from the entire flow of light, this thus makes a certain contribution to the light distribution in the light pattern (the entire flow of light produces the (overall) light distribution). A structural element now modifies a light bundle LB1 passing through the structural element in such a way that the unmodified contribution to the overall light distribution is altered according to the scattering function. By way of example, the unmodified light bundle produces a light distribution contribution having a certain form, i.e. certain regions on the roadway or on a measuring screen are lit, other region are unlit. Due to the structural element 110, regions outside the originally lit region are now also lit with a certain intensity according to the scattering function PSF, whereas—since the overall flow of light remains constant—the intensity is reduced at least in parts of the region originally lit with the unmodified light bundle.

As mentioned in conjunction with FIG. 12, it is advantageous when the entire defined area 5*a* is covered by the optical structural elements 110.

It is also particularly advantageous when all structural elements 110 are substantially identical. Each structural element then modifies the flow of light passing therethrough in a manner identical to all other structural elements.

Here, "substantially" identical means that in the case of a planar surface, on which the structural elements are arranged, these are actually identical.

In the case of curved surfaces, such as a light exit surface 5*a* of a lens 5, the structural elements are each formed identically in their central region, whereas the edge regions of different structural elements may differ (slightly) from one another by the curvature of the surface.

In a specific embodiment all structural elements 110 are accordingly identical in respect of a planar surface or a surface 111 intended to be planar.

The structural elements are calculated accordingly for a planar surface; if these identical structural elements thus calculated are placed—with identical orientation—on a curved surface, for example of a lens, the structural elements are thus still mapped identically in their central region, as already mentioned above; in the regions of transition to the original lens surface, on which the structural elements are placed, the structural elements have a different shape however depending on the position on the lens surface on account of the curvature of the lens surface, which with the small size of the structural elements results in no or only very slight effects on the light distribution.

It is also advantageous when all structural elements 110 are identically oriented.

With a planar defined area no further explanations are necessary. With curved surfaces (for example: lens), the structural elements are arranged identically along axes through the surface, which axes extend parallel to an axis of symmetry or to an optical axis of the surface (and not normal to the surface normal).

This has manufacturing advantages in particular, since the optical structure and the tool for producing the structure can be easily removed in this way, since no undercuts can form on the optical structure.

An optical structure according to the invention or a modified light pattern can be produced optimally when the scattering function PSF is a point-spread function.

It is also advantageous if the symmetry of a structural element is dependent on the symmetry of the scattering function PSF. The structural element generally has the same class of symmetry as the PSF. If, by way of example, the PSF is mirror-symmetrical horizontally, the structural element thus also has a horizontal mirror symmetry.

Returning again to FIG. 12, it can be seen that in the shown embodiment of the invention the structural elements 110 have a circular cross section at their base. With a curved defined area, over which the structural elements are arranged, the projection of the base—that is the area over the defined area occupied by a structural element—is considered in a plane.

Structural elements are thus preferably substantially rotationally symmetrical, but depending on the application may have different deformations, i.e. deviations from this rotationally symmetrical structure, wherein these deformations can be formed over a large area, generally from locally.

It is also advantageous for the dimensions of a structural element 110, therefore in the shown case the diameter d and/or the height h of the structural element 110, to be greater, in particular much greater than the wavelength of visible light, and therefore diffraction effects can be avoided.

Here, the height h of the structural elements 110 lies in the μm range.

By way of example, the height of the structural elements 110 lies in the range of 0.5-5 μm, wherein the height h of the structural elements 110 preferably lies in the range of 1-3 μm.

In a specific embodiment the height h of the structural elements 110 is approximately 2.7 μm.

In a specific embodiment, for example in variants having the above-described heights, the diameter d of the structural elements 110 lies in the millimeter range.

By way of example, the diameter d of the structural elements 110 is between 0.5-2 mm, wherein the diameter d or a length of the structural elements 110 is approximately 1 mm.

In an exemplary embodiment of a lens on which the structural elements are arranged, the diameter of the lens is 90 mm.

An optical structure can be produced easily when the defined area 111 (which in the shown example is the lens face 5*a*) over which the structural elements 110 are distributed is divided into a—virtual—preferably regular grid structure (200), such as that shown in FIG. 13. Here, the structural elements 110 are arranged at the grid points 201 or between the grid points 201 of the grid structure 200.

FIG. 14 shows how a structural element 100 with a circular base sits on each grid point 201 of the grid structure 200.

Such an arrangement is advantageous in particular also in respect of an optimal optical effect of the optical structure, since the optical effect of the optical structure can thus be adjusted in an optimal manner.

The "regularity" of the structure is to be considered here, in the case of a curved optical area over which the optical structure is arranged, in respect of a projection of this defined area into a plane, wherein—on account of the short grid spacing—the grid can be considered as planar even with a curved defined area in the region of adjacent grid points.

In accordance with the shown preferred embodiment of the invention the grid structure forms a hexagonal grid 200. In this way an optimal filling of the defined area can be achieved, in particular in the case of structural elements 110 having a circular base, and therefore approximately 87% of the defined area is covered by structural elements 100 and merely approximately 13% unmodified area 111 (see FIG. 15) is present.

Where possible, as shown in FIG. 15, the base areas of the structural element 110 are arranged relative to one another or have such a diameter that adjacent structural elements 110 transition into one another, preferably in the sense that they just contact one another. An optimal area filling can be achieved in this way.

From an optical viewpoint it is optimal when the transition of the structural elements 110 to the defined area 111 is continuous, preferably C2 continuous, i.e. is implemented with continuous tangents.

FIG. 18 lastly also shows a structural element 110 having a circular base in a plan view, FIG. 18*a* shows a section through the optical structural element from FIG. 18 along the line A-A, FIG. 18*b* shows the optical structural element from FIG. 18 in a section along the line B-B, and FIG. 18*c* shows the optical structural element from FIG. 18 in a section along the line C-C.

The structural element 110 shown in FIGS. 18, 18*a*-18*c*, which is particularly well suited in particular for providing a gradient softening and a signlight function, is characterised as already mentioned by a circular base having a radius r. FIG. 18 also shows an (x, y) coordinate cross with the origin in the centrepoint of the circle with radius r. The z direction, which is normal to the planes spanned by x and y, corresponds substantially to the light exit direction or runs parallel to the optical axis of the lighting device, in which the optical structure consisting of such structural elements is used. Whereas the structural element, i.e. the surface 1110 of the structural element 110 in the positive y half, is largely distanced, apart from small regions, from the defined area over which the structural element 110 is arranged, the surface 1111 of the structural element 110 and the defined area coincide for the most part to the negative y half, apart from a region around the origin 0. The two surface regions 1110, 1110 are interconnected via transition areas 1112, 1113.

The optical structural element 110 reaches its maximum height above the origin 0 and continuously falls in the region 1110 toward its edge, i.e. toward the edge of the region 1110 with radius r, preferably C0 continuously. The region 1110 of the optical element distanced from the defined area preferably has a circular symmetry, i.e. points on the surface 1110 with identical normal distance from the defined area lie over a circle having a centrepoint in the origin.

The region 1110 also has a flattened region 1110', which extends concentrically around the centrepoint 0 and extends as far as the transition areas 1112, 1113. The flattened region 1110' extends here for example over a width of approximately 0.05-0.1 times the radius r and lies in a region between 0.4 and 0.6 radii r about the centrepoint 0.

The transition area 1113 extends parallel to the x direction, the distance r' of the area 1113 to the x axis is approximately 0.3-0.5 radii r, preferably 0.4 radii r (ya=+/−(0.3-0.5) r, preferably ya=+/−0.4 r. The transition area 1113 extends on either side of the y axis preferably as far as the flattened region 1110'.

The transition areas 112 extend symmetrically to the y axis, the distance r" of both areas 1112 to a straight line parallel to the area 1112, which straight line extends through the centrepoint 0, lies in the range of 0.4-0.6 radii r, preferably at approximately 0.55 r. The areas 1112 intersect the x axis in each case at approximately xs=+/−(0.6-0.8) r, preferably xs=+/−0.75 r.

The transition area 1113 is, as illustrated, preferably flattest on the y axis and becomes increasingly steeper toward the edge r.

The transition between the transition areas 1112, 1113 and the areas 1110 is preferably implemented C0 continuously, as is the transition toward the area 1111.

The illustrated structural element is illustrated approximately 25 times exaggerated in order to make visible any differences in the gradients. The gradient angles of the surface of the structural element actually lie in the region 1110 between approximately 0° and 1°, and naturally in the region 1111 at 0°.

In the transition regions the gradients are approximately 2°-3°.

Whereas beams can pass through the area 1111 unhindered, the region 1110 scatters penetrating light in such a way that this leads to a softening of the gradient in the light pattern. The transition areas with their greater gradients by contrast deflect upwardly any light beams passing through, such that these lie in the light pattern above the horizontal line and lead to a signlight function.

FIG. 19 shows as a further exemplary application in the left-hand image an unmodified light distribution, consisting of individual light segments, which are arranged in columns and rows. As can be seen in FIG. 19, adjacent individual light distributions have a distance d1 in a horizontal direction, wherein all distances d1 are identical. Adjacent distributions LS1 furthermore have distances d2 in the vertical direction, wherein all vertical distances are identical. Furthermore, it is preferably true that d1=d2.

The distributions or light segments LS1 typically have, although this is not limiting, a width and/or a height of approximately 1°. In the case of rectangular light segments these usually have a (slightly) greater extension in vertical height than in the horizontal direction.

Due to the distance between the light segments LS1, dark gaps are formed in the light pattern. The width of these gaps (which corresponds to the distances d1, d2) is typically less than or equal here to 0.5° and greater than 0°, generally less than or equal to 0.2° or less than or equal to 0.1°. A typical range for the width d1, d2 of the gaps lies between 0.05° and 0.15°.

The light intensity is substantially identical in all individual light distributions LS1, and the intensity in the individual light distributions LS1 is also advantageously substantially homogeneous over the entire area of the individual light distribution, as is indicated schematically in FIG. 20 on the left-hand side.

Due to the optical structure, part of the light beam which without optical structure generates exclusively an individual light distribution LS1 is deflected into the gap regions framing this individual light distribution LS1, which gap regions are produced as a result of the distancing of the individual lights distributions LS1 from one another.

With an optical structure according to the invention as described above, a scattering of the light radiated into these light segments can now be achieved, and therefore the grid structure as shown in FIG. 19 is no longer discernible or is only discernible to an extent that is no longer bothersome and is legally compliant (FIG. 19, right-hand side).

The dark edge regions around the individual light distributions are thus lit up exclusively by light from individual light distributions bordering these edge regions, such that, when individual light distributions are switched off, the switched-off regions in the overall light pattern still appear dark and are not lit by scattered light "from" other individual light distributions.

FIG. 20 schematically shows the profile of the light intensity with an unmodified light pattern. In the light segments LS1 the light intensity I is constantly at a value I=I1 and in the gaps the intensity I=0.

With the optical structure only part of the flow of light forming exactly one light segment LS1 is scattered into the adjacent edges. The intensity in the modified light segments LS1' is thus reduced to a value I1' (wherein the shape of the segments LS1 also corresponds to the unmodified light segments LS1'), however some of the light for the original segment LS1 is scattered into the adjacent edges. The amount of scattered light is selected here via the optical structure (or designed in accordance with the optical structure) in such a way that, in a gap as on the right-hand side of FIG. 20, the intensity is I=I1' at the edge of the light segment LS1' in question and then decreases linearly to the value I=0, wherein I=0 at the edge of the adjacent light segment LS1'. An overall intensity in the gap of I=I1' can thus be achieved (FIG. 20), since the intensities of the scattered light from both adjacent light segments are added.

With the invention is possible to describe signlight and gradient softening via a point-spread function and to implement this in a single optical structural element, which repeats itself in the optical structure. The described procedure delivers a high flexibility in respect of the appearance of the gradient (or the softness of the HD boundary), and, in contrast with geometry-centred approaches from the prior art, the visual impression can be relatively easily modelled and implemented via the point-spread function.

The invention claimed is:

1. An optical structure (100) for a lighting device (1) of a motor vehicle headlight, wherein light radiated from the lighting device (1) forms a predefined light distribution (LV1), the optical structure comprising:

at least one optics element (5, 6); and a plurality of optical structural elements (110) which are distributed over at least one defined area (111) of the at least one optics element and which are configured to provide a light-scattering effect, wherein the at least one defined area (111) is divided into a virtual, hexagonal grid structure (200) and the plurality of optical structural elements are arranged at grid points (201), or between the grid points (201), of the virtual, hexagonal grid structure (200), wherein the predefined light distribution (LV1) comprises a segmented light distribution formed from individual light distributions (LS1), wherein the individual light distributions (LS1) are arranged inn rows and m columns, wherein n>1, m≥1 or n≥1, m>1, wherein the optical structure (100) of the lighting device (1) is associated with the lighting device (1) or is part of the lighting device (1) such that substantially all light from the lighting device (1) passes through the optical structure (100), and the unmodified light distribution produced by the lighting device (1) is modified by the optical structure (100) into a predefinable, modified light distribution (LV2), wherein the predefinable, modified light distribution (LV2) is formed by convolution of the unmodified light distribution with a scattering function (PSF), wherein adjacent optical structural elements (110) of the plurality of optical structural elements (i) are arranged in contact with one another, or (ii) are isolated from one another and do not contact one another, wherein the optical structural elements (110) are configured to provide that at least some of the light of the lighting device (1) is deflected into boundary regions, in each of which two individual light distributions are arranged adjacently to one another, and wherein the plurality of optical structural elements is arranged on at least one boundary surface of the at least one optics element, and the at least one optics element is a diffusing plate or covering plate (6) of the lighting device (1).

2. The optical structure of claim 1, wherein the plurality of optical structural elements (110) is formed such that each optical structural element (110) modifies a light bundle (LB1) passing through the optical structural element (110) into a modified light bundle (LB2) according to a scattering function.

3. The optical structure of claim 1, wherein the optical structure is arranged on at least one surface of the at least one optics element in the form of a projection lens of the lighting device (1).

4. The optical structure of claim 3, wherein the optical structure is arranged on a light exit side (5*a*) of the projection lens (5).

5. The optical structure of claim 1, wherein the plurality of optical structural elements (110) is distributed over all of the at least one boundary surface (5*a*, 6*a*) of the at least one optics element (5, 6).

6. The optical structure of claim 1, wherein all of the plurality of optical structural elements (110) are substantially identical.

7. The optical structure of claim 6, wherein all of the plurality of optical structural elements (110) are identical relative to a planar surface (111) or a surface (111) intended to be planar.

8. The optical structure of claim 1, wherein all of the plurality of optical structural elements (110) are identically oriented.

9. The optical structure of claim 1, wherein the scattering function (PSF) is a point-spread function.

10. The optical structure of claim 1, wherein a diameter, a height, and/or another dimension of one or more of the plurality of optical structural elements is/are greater than a wavelength of visible light.

11. The optical structure of claim 10, wherein the height (h) of the plurality of optical structural elements (110) lies in the μm range.

12. The optical structure of claim 11, wherein the height (h) of the plurality of optical structural elements (110) lies in the range of 0.5 μm to 5 μm.

13. The optical structure of claim 12, wherein the height (h) of the plurality of optical structural elements (110) lies in the range of 1 μm to 3 μm.

14. The optical structure of claim 13, wherein the height (h) of the plurality of optical structural elements (110) is approximately 2.7 μm.

15. The optical structure of claim 10, wherein the diameter (d) or a length of the plurality of optical structural elements (110) lies in the millimeter range.

16. The optical structure of claim 15, wherein the diameter (d) or the length of the plurality of optical structural elements (110) lies between 0.5 mm and 2 mm.

17. The optical structure of claim 16, wherein the diameter (d) or the length of the plurality of optical structural elements (110) is approximately 1 mm.

18. The optical structure of claim 1, wherein each of the plurality of optical structural elements (110) has a circular cross section at its base.

19. The optical structure of claim 1, wherein precisely one of the plurality of optical structural elements (110) is arranged at each grid point (201) or between the grid points (201) of the virtual, hexagonal grid structure (200).

20. The optical structure of claim 1, wherein adjacent grid points (201) are arranged at a distance from one another that is in a range from 0.5 mm to 2 mm.

21. The optical structure of claim 1, wherein the optical structural elements of the plurality of optical structural elements (110) are distributed randomly over the defined area (111).

22. The optical structure of claim 1, wherein the plurality of optical structural elements (110) transition to the defined area (111) in a continuous manner.

23. The optical structure of claim 1, wherein the lighting device (1) is configured to map light radiated therefrom as a dipped beam distribution, wherein the dipped beam distribution has a light-dark boundary (HD1), wherein a gradient of the light-dark boundary (HD1) of the unmodified light distribution of the lighting device (1) is reduced.

24. The optical structure of claim 1, wherein the lighting device is configured to map light radiated therefrom as a dipped beam distribution, wherein the dipped beam distribution has a light-dark boundary (HD1), wherein a portion of the light of the lighting device (1) is mapped into a region (LV2') above the light/dark boundary (HD1, HD2).

25. The optical structure of claim 24, wherein deflected light lies in the region (LV2') between 1.5° and 4° above the HD line.

26. The optical structure of claim 24, wherein approximately 1% of the light of the lighting device (1) is deflected by the optical structural elements into the region (LV2') above the light-dark boundary (HD1, HD2).

27. The optical structure of claim 1, wherein adjacent individual light distributions (LS1) of the unmodified light distribution are arranged at a defined distance or defined distances (d1, d2) from one another.

28. The optical structure of claim 1, wherein the individual light distributions (LS1) of the unmodified light distribution have a rectangular or square shape with a projection onto a vertical plane.

29. The optical structure of claim 27, wherein all distances (d1) between the adjacent individual light distributions (LS1) are identical in a horizontal direction.

30. The optical structure of claim 27, wherein all distances (d2) between the adjacent individual light distributions (LS1) are identical in a vertical direction.

31. The optical structure of claim 27, wherein the individual light distributions (LS1) have a width and/or a height of approximately 1°.

32. The optical structure of claim 27, wherein the defined distance (d1, d2) between two adjacent individual light distributions (LS1) is less than 0.5° and greater than 0°.

33. The optical structure of claim 32, wherein the defined distance (d1, d2) between two adjacent individual light distributions (LS1) is less than 0.2°.

34. The optical structure of claim 32, wherein the defined distance (d1, d2) between two adjacent individual light distributions (LS1) lies between 0.05° and 0.15°.

35. The optical structure of claim 32, wherein the defined distance between two adjacent individual light distributions (LS1) is less than or equal to 0.1°.

36. The optical structure of claim 1, wherein an average light intensity in a gap between two individual light distributions (LS1) produced with light intended for an individual light distribution corresponds to half an average light intensity in an adjacent individual light distribution (LS1) of the modified light distribution.

37. The optical structure of claim 1, wherein part of the light produced by one individual light distribution (LS1) is deflected by the optical structure into gap regions framing the individual light distribution (LS1), which gap regions are formed by the distance between the individual light distributions (LS1) from one another.

38. The optical structure of claim 37, wherein, proceeding from a considered individual light distribution (LS1), a light intensity in an adjacent gap region decreases in a direction of an adjacent individual light distribution (LS1), wherein the decrease is linear.

39. The optical structure of claim 38, wherein the light intensity decreases to zero.

40. The optical structure of claim 37, wherein the light intensity in a gap region directly adjacent to an edge of the considered individual light distribution (LS1) corresponds substantially to a light intensity of the individual light distribution (LS1) of the modified light distribution at an edge thereof or to an average light intensity in the individual light distribution (LS1) of the modified light distribution.

41. The optical structure of claim 1, which is configured such that substantially all of the light of the lighting device (1) impinges on the optical structure (100).

42. The optical structure of claim 1, which is configured such that the optical structure is lit up substantially homogeneously.

43. A lighting device comprising at least one optical structure (100) according to claim 1.

44. The lighting device of claim 43, wherein the lighting device (1) is a projection system.

45. The lighting device of claim 44, wherein the lighting device (1) comprises at least one light source (3), at least one reflector (2), and at least one lens (5) comprising a projection lens.

46. The lighting device of claim 45, wherein the at least one optical structure (100) is arranged on the lens (5) and/or an additional covering plate or diffusing plate.

47. The lighting device of claim 43, wherein the lighting device (1) is a reflection system.

48. The lighting device of claim 47, further comprising at least one free-form reflector (2), at least one light source (3), at least one diffusing plate (6), and/or at least one covering plate (6).

49. The lighting device of claim 48, wherein the at least one optical structure (100) is arranged on the at least one diffusing plate (6), the at least one covering plate (6), and/or an additional covering or diffusing plate.

50. A vehicle headlight comprising at least one lighting device of claim 43.

51. A method for producing the optical structure of claim 1, wherein the modified light distribution (LV2) is modified by convolution of the unmodified light distribution with the scattering function (PSF), and wherein the unmodified light distribution (LV1) is modified according to the scattering function.

52. The method of claim 51, wherein each of the plurality optical structural elements (110) modifies a light bundle (LB1) passing through each of the plurality if optical structural elements (110) into a modified light bundle (LB2) according to the scattering function (PSF).

53. The method of claim 51, wherein the scattering function (PSF) is a point-spread function.

54. The method of claim 51, wherein the lighting device (1) is configured to map light radiated therefrom in the form of a dipped beam distribution, wherein the dipped beam distribution has a light-dark boundary (HD1), wherein the plurality of optical structural elements (110) or the scattering function is configured such that a gradient of a light-dark boundary (HD1) of the unmodified light distribution of the lighting device (1) is reduced.

55. The method of claim 51, wherein the lighting device is configured to map light radiated therefrom in the form of a dipped beam distribution, wherein the dipped beam distribution has a light-dark boundary (HD1), wherein a portion of the light of the lighting device (1) is mapped into a region (LV2') above the light/dark boundary (HD1, HD2).

56. A method for producing the optical structure of claim 1, wherein the lighting device (1) is configured to map light radiated therefrom in the form of the individual light distributions (LS1) mapped in n rows and m columns, wherein $n>1$, $m\geq1$ or $n\geq1$, $m>1$, wherein the individual light distributions (LS1) together form a full beam light distribution, and wherein the plurality of optical structural elements (110) or the scattering function is configured such that at least some of the light of the lighting device (1) is deflected into the boundary regions, in each of which two individual light distributions are arranged adjacently to one another.

* * * * *